US006149052A

United States Patent [19]

Mueller

[11] Patent Number: 6,149,052

[45] Date of Patent: Nov. 21, 2000

[54] RAPID ASSEMBLY BOX WITH TWO-PART ADHESIVE BOTTOM

[76] Inventor: Charles J. Mueller, 140 W. Kohler St., Sun Prairie, Wis. 53590

[21] Appl. No.: 09/363,452

[22] Filed: Jul. 29, 1999

Related U.S. Application Data

[63] Continuation-in-part of application No. 09/276,064, Mar. 25, 1999, which is a continuation-in-part of application No. 08/936,329, Sep. 24, 1997, Pat. No. 5,887,782.

[51] Int. Cl.[7] ..... B65D 5/00

[52] U.S. Cl. ..... 229/183; 229/136; 229/117; 229/117.03; 229/117.04; 229/917

[58] Field of Search ..... 229/117.01, 137, 229/183, 199, 117.16, 117.24, 128, 155, 142, 125.37, 125.39, 117, 117.05, 136

[56] References Cited

U.S. PATENT DOCUMENTS

| | | | |
|---|---|---|---|
| 641,500 | 1/1900 | Davidson . | |
| 732,071 | 6/1903 | Hartrampf . | |
| 783,089 | 2/1905 | Wildmann . | |
| 1,375,489 | 4/1921 | Davis . | |
| 1,470,398 | 10/1923 | Smith . | |
| 1,936,136 | 11/1933 | Lindgren . | |
| 2,018,171 | 10/1935 | Himes . | |
| 2,214,813 | 9/1940 | Guyer . | |
| 2,217,757 | 10/1940 | Lindley | 229/917 X |
| 2,348,378 | 5/1944 | Goodyear . | |
| 2,418,963 | 4/1947 | Anderson, Jr. . | |
| 2,472,698 | 6/1949 | Edtmiller . | |
| 2,572,123 | 10/1951 | Edtmiller | 229/117 |
| 2,657,851 | 11/1953 | Metzger | 229/117 |
| 2,874,891 | 2/1959 | Kelsal | 229/136 |
| 2,943,780 | 7/1960 | Bolding | 229/117 X |
| 3,254,823 | 6/1966 | Shina . | |
| 3,366,496 | 1/1968 | Bomar et al. . | |
| 3,667,666 | 6/1972 | Pryor . | |
| 5,217,159 | 6/1993 | Calvert et al. | 229/136 |
| 5,735,454 | 4/1998 | Jensen | 229/123.1 |
| 5,887,782 | 3/1999 | Mueller . | |

OTHER PUBLICATIONS

Photographs of MUELLER MATIC® container on sale prior to Mar. 25, 1998.

*Primary Examiner*—Allan N. Shoap
*Attorney, Agent, or Firm*—Lathrop & Clark LLP

[57] ABSTRACT

A corrugated box has two side panels joined by parallel end panels. An automatic bottom panel extends from a side panel, and has two converging reverse-scored fold lines which extend between a side panel and the outer edge of the automatic bottom panel. End flaps are folded up from the automatic bottom panel and are connected to the end panels to form box side walls. One of the end flaps has a diagonal fold line, with portions of the flap above the diagonal fold line only being adhered to the end panel. The angles of the reverse scored fold lines are selected depending on the dimensions of the box to allow the automatic bottom panel to be deployed from a folded position alongside the side and end panels to an assembled position perpendicular to the side and end panels, simply by displacing one side panel with respect to the other. A strip of latex dry seal gum adhesive is applied to the box interior bottom panel, as well as to the box automatic bottom panel, such that when the box is erected the two strips overlie each other and form an adhesive bond, thereby increasing the box bottom strength. The two strips of adhesive are applied to opposing faces of the corrugated blank, and in the box collapsed condition are facing away from each other and are shielded on the inside of the collapsed assembly, being thereby protected from dust and other contamination to provided an extended adhesive life.

4 Claims, 3 Drawing Sheets

RAPID ASSEMBLY BOX WITH TWO-PART ADHESIVE BOTTOM

CROSS REFERENCES TO RELATED APPLICATIONS

This application is a continuation-in-part of application Ser. No. 09/276,064, filed Mar. 25, 1999, which is a continuation-in-part of application Ser. No. 08/936,329, filed Sep. 24, 1997, now U.S. Pat. No. 5,887,782, the disclosures of which are incorporated by reference herein.

BACKGROUND OF THE INVENTION

The present invention relates to corrugated paperboard containers in general, and to boxes which can be assembled from a glued-up blank without external fasteners in particular.

One of the most economical and versatile containers is the corrugated paperboard box formed from die cut, scored, glued, and folded corrugated sheet stock. The corrugated box is lightweight for its strength, economically produced, compact in its collapsed condition, and ultimately recyclable.

Corrugated containers for producers may be assembled with the aid of automated equipment, tape dispensers, and adhesives. In many applications, however, a corrugated container must be assembled in the field, one at a time, as the need dictates. For consumer applications where the assembly environment is unpredictable, it is preferable that the box be capable of assembly without the need for tools or external adhesive materials.

Corrugated paperboard boxes have been produced, which, although not having an automatic bottom, have strips of gum seal adhesive which are brought together to seal the bottom side flaps to the bottom end flaps. However, some portions of the adhesive strips were positioned to face outwardly where they were readily subject to contamination.

In my U.S. Pat. No. 5,887,782, I disclosed a corrugated container having an automatic bottom which permitted a rapid, convenient, and repeatable opening and closing of a box. This container employed an interior bottom panel which folds down to overlie the scored automatic bottom panel, to present a container with a double thickness bottom.

U.S. Pat. No. 1,936,136, the disclosure of which is incorporated by reference herein, discloses a cardboard box or tray in which end flaps are connected in an erected configuration by an adhesive which adheres only to a like adhesive.

In certain applications, however, even greater strength is required in a container bottom, and for such applications a box which can be assembled without external fasteners or tape and which has a higher strength bottom would be desirable.

SUMMARY OF THE INVENTION

The corrugated paperboard box of this invention has two side panels which are joined by parallel end panels. An automatic bottom panel extends from a side panel, and has two converging reverse-scored fold lines which extend between a side panel and the outer edge of the automatic bottom panel. End flaps are folded up from the automatic bottom panel and are adhesively connected to the end panels to form double ply side walls to the box. One of the end flaps has a diagonal fold line, with portions of the flap above the diagonal fold line only being adhered to the end panel. The angles of the reverse scored fold lines are selected depending on the dimensions of the box to allow the automatic bottom panel to be deployed from a folded position alongside the side and end panels to an assembled position perpendicular to the side and end panels, simply by displacing one side panel with respect to the other. A strip of latex dry seal gum adhesive is applied to the box inner bottom flap, as well as to the box automatic bottom panel, such that when the box is erected the two strips overlie each other and form an adhesive bond, thereby increasing the box bottom strength. The two strips of adhesive are applied to opposing faces of the corrugated blank, and in the box collapsed condition are facing away from each other and are shielded on the inside of the collapsed assembly, being thereby protected from dust and other contamination to provided an extended adhesive life.

It is an object of the present invention to provide a corrugated box with an automatic bottom in which the two flaps defining the bottom are fastened to one another.

It is also an object of the present invention to provide a corrugated box with a higher strength bottom.

It is an additional object of the present invention to provide a corrugated box with an automatic bottom involving a two part adhesive fastening system, in which the two parts of the adhesive are kept separate from one another and protected from contamination when the box is in a collapsed configuration.

It is a further object of the present invention to provide a container in which exposed patches of glue are kept from contamination by fingerprints or dust by being folded into the interior of the box.

It is an additional object of the present invention to provide a container, which, when the box is set up, items placed in the container cause bonding between multiple bottom panels, and deformation of the outside bottom panel is minimized.

Further objects, features and advantages of the invention will be apparent from the following detailed description when taken in conjunction with the accompanying drawings.

DESCRIPTION OF THE PREFERRED EMBODIMENTS

Figure 1:
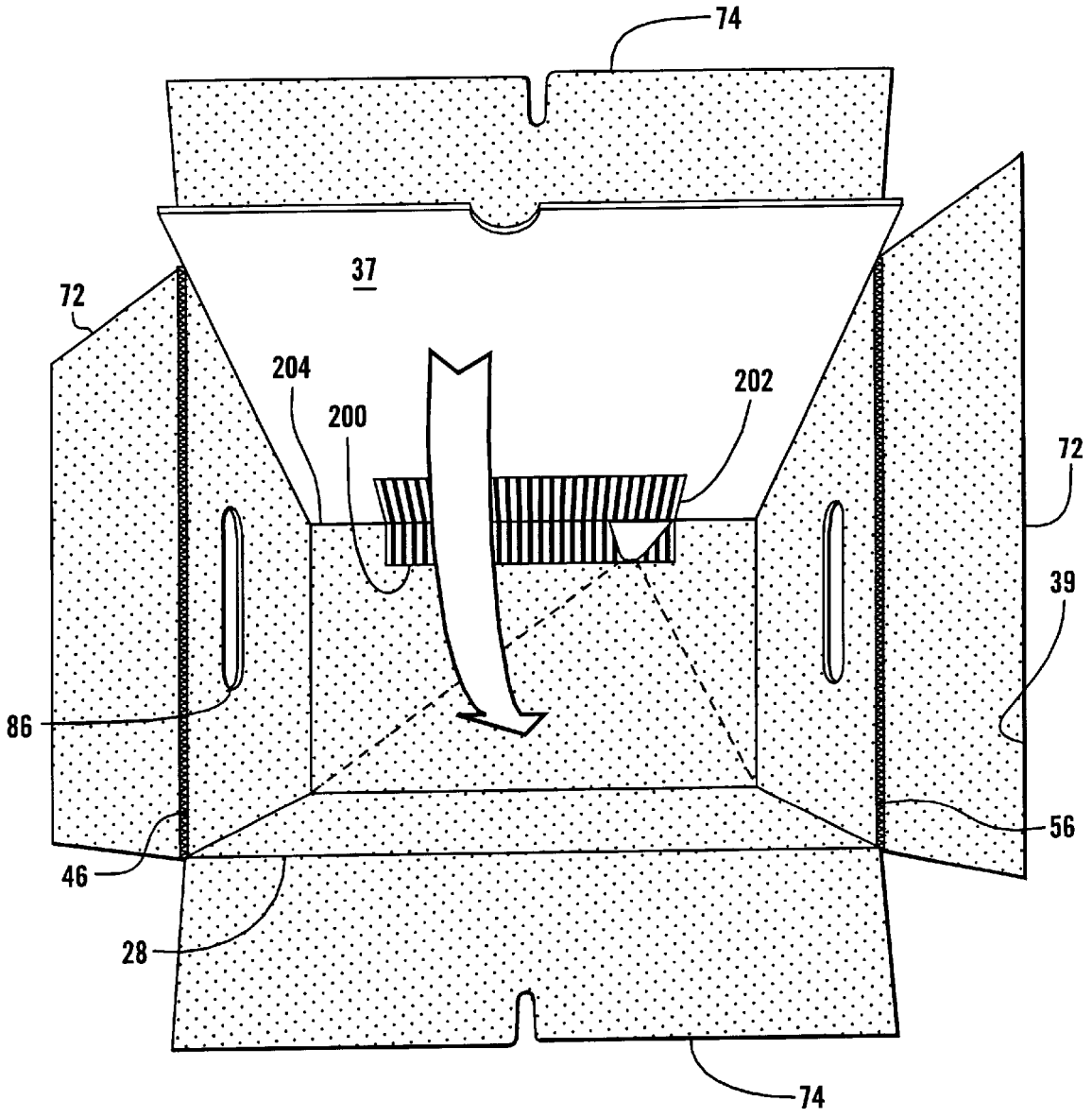
FIG. 1 is a simplified perspective view of the interior of a partially assembled box of this invention, showing the two regions of gum adhesive prior to contact.

Referring more particularly to FIGS. 1–5, wherein like numbers refer to similar parts, a corrugated paperboard box 20 of this invention is shown in FIG. 1. The box 20 is formed in a knocked-down condition at the factory from a single corrugated paperboard blank 22, shown in FIG. 2. The blank 22 is cut, folded, and adhesively connected such that the knocked-down article is readily expandable into a box with minimal effort by the end user and without the need for connectors or adhesives in the final box assembly. In addition, as described more fully below, a sturdy bottom is formed by the connection of two regions of dry seal gum adhesive positioned on opposite faces of the paperboard blank.

Figure 2:
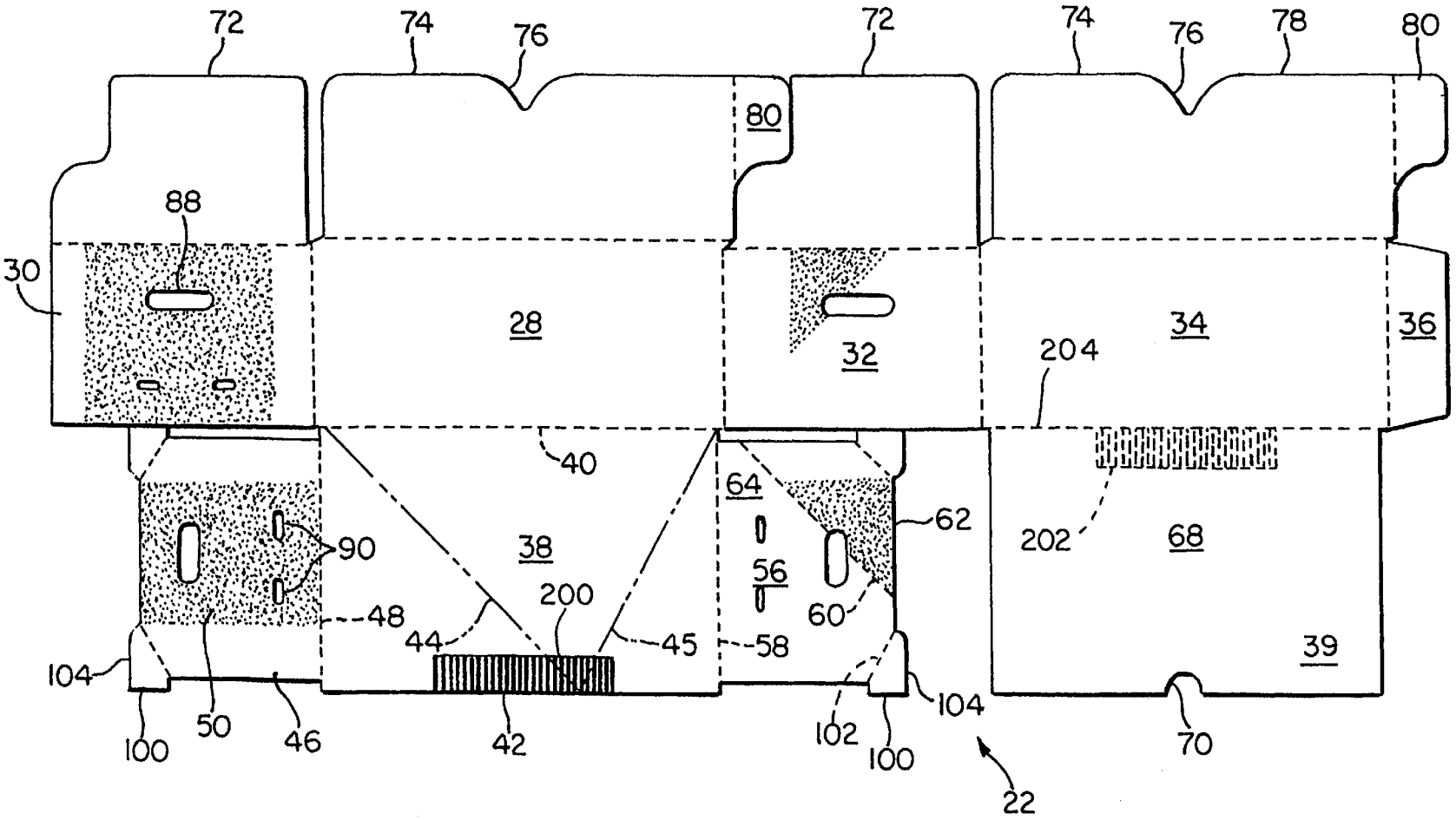
FIG. 2 is a top plan view of the exterior of a blank for assembly into the box of FIG. 1.

The blank 22, as shown in FIG. 2, is for the fully enclosable box 20. However, it should be noted that blanks may likewise be fabricated for boxes which are open or which lack top closure flaps. The blank 22 is a single thickness of conventional corrugated paperboard, having one, two, or more plies of corrugations, depending on the ultimate strength required. The blank 22 is die-cut and folded to minimize waste or un-utilized segments of corrugated paperboard. The box 20 is preferably generally rectangular, and therefore the blank 22 has a rectangular first side panel 28, with a first end panel 30 extending along a fold line on one side of the first side panel, and a second end panel 32 extending along a fold line on the other side. A second side panel 34, of dimensions similar to the first side panel 28, extends along a fold line from the second end panel 32. A glue flap 36 extends from the second side panel 34 along a fold line. The glue flap 36 is adhesively connected to the exterior of the first end panel 30. It should be noted that the glue flap may alternatively be connected to the interior of the first end panel 30. The side panels and the end panels form the vertically extending side walls of the assembled box 20. For cosmetic purposes, the box blank 22 may be printed or coated on an exterior face 37, while the interior face 39 of the blank will remain uncoated.

Figure 3:
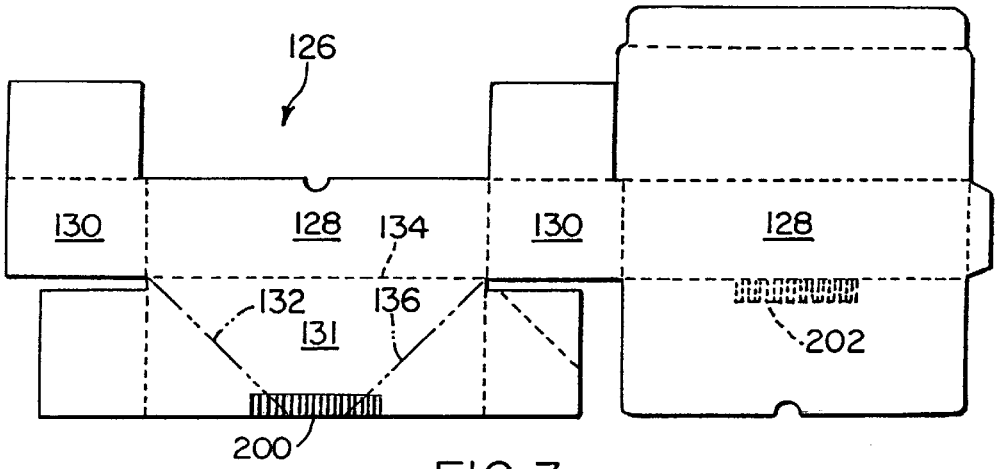
FIG. 3 is a simplified schematic view of a corrugated blank for assembly into the box of this invention wherein the width of the box sides is greater than twice the width of the box ends.
Figure 5:
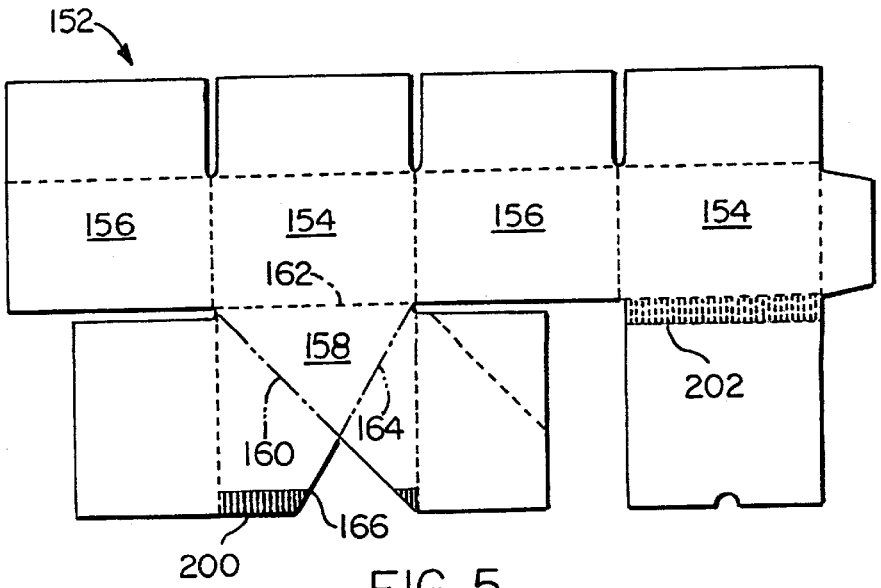
FIG. 5 is a simplified schematic view of a corrugated blank for assembly into the box of this invention wherein the width of the box sides is the same as the width of the box ends.

An automatic bottom panel 38 extends from the first side panel 28 along a bottom fold line 40. The automatic bottom panel 38 is generally rectangular with a width approximately equal to the horizontal width of the side panels, and a length approximately equal to the horizontal width of the side panels. The automatic bottom panel 38 has an outer edge 42 which is spaced parallel from the bottom fold line 40. A first reverse-scored diagonal fold line 44 extends from the bottom fold line 40 to the outer edge 42. The first reverse fold line 44 must extend at about 45 degrees from the bottom panel fold line 40. A second reverse-scored diagonal fold line 45 extends from the bottom panel fold line 40 the outer edge 42. The first fold line 44 converges toward the second fold line 45. When the box 20 has side panels which are less than twice the width of the end panels, the first fold line and the second fold line will meet along the outer edge 42. For boxes of different dimensions, the two fold lines may terminate at different positions along the outer edge, as shown in FIGS. 3 and 5 and discussed in greater detail below. Nevertheless, the angle of the first reverse fold line 44 will always be about 45 degrees. To facilitate folding of the automatic bottom panel 38, the point where the first fold line and the second fold line meet along the outer edge 42 may have a cut-out 47 removed, as shown in FIG. 1.

A first region 200 of dry seal adhesive is positioned on the interior face 39 of the automatic bottom panel 38. The term dry seal adhesive, as used herein, is intended to mean an adhesive which, once applied, is dry to the touch, and will generally not adhere or will only lightly adhere to paperboard, but will readily adhere to a like adhesive applied to another portion of paperboard. Rubber cement is a dry seal adhesive according to this definition. A preferred dry seal adhesive is H. B. Fuller RX-586, available from H. B. Fuller Company, 311 Hicks Road, Palatine, Ill. 60067. This material is described by the manufacturer as a waterbase product, which is a latex dry seal gum. The first dry seal adhesive region 200 is preferably disposed adjacent the outer edge 42 of the automatic bottom panel, and may be a rectangular strip which extends along about ⅔ of the outer edge, and which is about ⅛ of the depth of the automatic bottom panel. As described below, the first dry seal adhesive region will adhere to another similar region on an interior bottom panel of the box.

A first generally rectangular end flap 46 extends from the automatic bottom panel 38 along a first end flap fold line 48. A first angle is defined between the first end flap fold line 48 and the first fold line 44. A rectangular attachment region 50, indicated in FIG. 2 by a stippling pattern, is defined on the exterior face of the first end flap 46. In manufacture of the box 20, adhesive is applied to the attachment region 50 and the first end flap 46 is glued to the first end panel 30 to form a multi-ply end wall. It should be noted that the box 20 may be provided with end wall pockets for the insertion of reinforcing corner pieces as disclosed in my U.S. Pat. No. 5,887,782.

A second rectangular end flap 56 extends from the automatic bottom panel 38 along a second end flap fold line 58. A second angle of approximately 45 degrees is defined between the second end flap fold line 58 and the second fold line 45 on the automatic bottom panel 38. In order for the automatic bottom panel 38 to be free to collapse, the second end flap 56 cannot be fully connected to the second end panel 32. The second end flap 56 is therefore formed with a diagonal fold line 60 which extends at a 45 degree angle from the bottom edge of the flap along the second end flap from a point adjacent the intersection of the second reverse-scored fold line 45 and the bottom fold line 40. The diagonal fold line 60 thus divides the second end flap 56 into an upper portion 62 which is adhesively connected to the second end panel 32, and a lower portion 64 below the diagonal fold line which is not connected to the second end panel. Adhesive is applied to the exterior face of the upper portion 62 of the second end flap 56 and brought into contact with the second end panel to connect the second end flap to the second end panel and create a second multi-ply end wall. The end flaps 46, 56, extend the full depth of the box to better contribute to the stacking strength of the box.

The automatic bottom panel, fixed to one end panel, and fixed along a diagonal fold line to the other panel, may thus be extended between a collapsed position alongside and substantially parallel to the side and end panels, and an assembled position substantially perpendicular to the side and end panels. This transformation of the finished blank from a compact, flat, corrugated assembly, to a dimensional storage box is effected by displacing the first side panel with respect to the second side panel, by, for example, gripping the flat assembly at the corners and applying pressure towards the interior of the assembly. This manipulation causes the article to expand into a box.

An interior bottom panel 68 extends along a fold line 204 from the second side panel 34. The interior bottom panel 68 has approximately the same dimensions as the automatic bottom panel 38, and, in the knocked-down position, lies adjacent and between the folded side panels 28, 34. As shown in FIG. 1, After the box 20 has been expanded so that the automatic bottom panel 38 forms the horizontal bottom of the box, the interior bottom panel 68 is pivoted downwardly to overlie the automatic bottom panel and there defines a flat, uncreased bottom to the box. To aid manipulation of the interior bottom panel 68, it may be provided with a finger opening cut-out 70. A second dry seal adhesive region 202 is disposed on the exterior face 37 of the interior bottom panel 68, preferably adjacent the fold line 204. The second dry seal adhesive region 202 is preferably similar in shape to the first dry seal adhesive region, although it may be larger or smaller.

It is an attribute of a dry seal adhesive that it will not adhere to material other than a similar dry seal adhesive. Therefore, when the box 20 is in the collapsed or unassembled configuration, the first dry seal adhesive region 200 will lie alongside the side top flap 74 and portions of the second end flap 56; and the second dry seal adhesive region 202 will lie alongside the second end panel 32 and the underside of the automatic bottom panel 38 near the bottom of the collapsed box. It should be noted that, although the dry seal adhesive is dry to the touch, and is generally non-adhesive, except to another dry seal adhesive, it is tacky, and will over time lose its adhesive powers if subjected to contaminants such as dust, dirt, paper fibers, and the like. Thus the assembly of the blank 22 in the unassembled configuration serves advantageously to protect the dry seal adhesive regions from contact with these contaminants, by causing the adhesive regions to be covered by other panels or portions of panels of the blank.

When the interior bottom panel 68 is pushed down into place over the erected automatic bottom panel 38, the two dry seal adhesive regions adhere to one another, forming a connection between the two adjacent panels. In addition, when the interior of the container is loaded, the contents will serve to press the interior bottom panel down onto the automatic bottom panel, forming a more secure bond between the two regions of dry seal adhesive. The connection of the two interior bottom panel to the automatic bottom panel, minimizes any tendency of the automatic bottom panel to deform about the fold lines.

Although the box 20 may be an open, uncovered container, it may be provided with a convenient closure to seal the box and protect the contents. As shown in FIGS. 1 and 2, an end top flap 72 extends upwardly from each end panel 30, 32. A side top flap 74 extends upwardly from each side panel 28, 34. The side top flaps 74 are preferably provided with a generally triangular cut-away 76 centered along the outer perimeter 78 of the flap. The width of the side top flaps 74 is greater than one half the width of the box 20. Thus, when the side top flaps 74 are folded down, the triangular cut-aways 76 engage so that portions of the side top flaps 74 overlap. The cover flaps may be provided with a hook-and-loop fastener arrangement or with a press closure arrangement, such as disclosed respectively in my U.S. Pat. No. 5,887,782, and in my pending application Ser. No. 09/276,064, entitled Transportable Container with Press Closure, the disclosures of which are incorporated by reference herein.

The box 20 is preferably provided with handholds 86 for convenient lifting and transporting of the box. A handhold 86 is defined in each end wall by aligned oblong cut-outs 88 in the end panels 30, 32 and the end flaps 46, 56. Because the handholds 86 are formed in double thicknesses of corrugated paperboard, the box is better able to support the loads imposed by lifting at the handholds.

Figure 4:
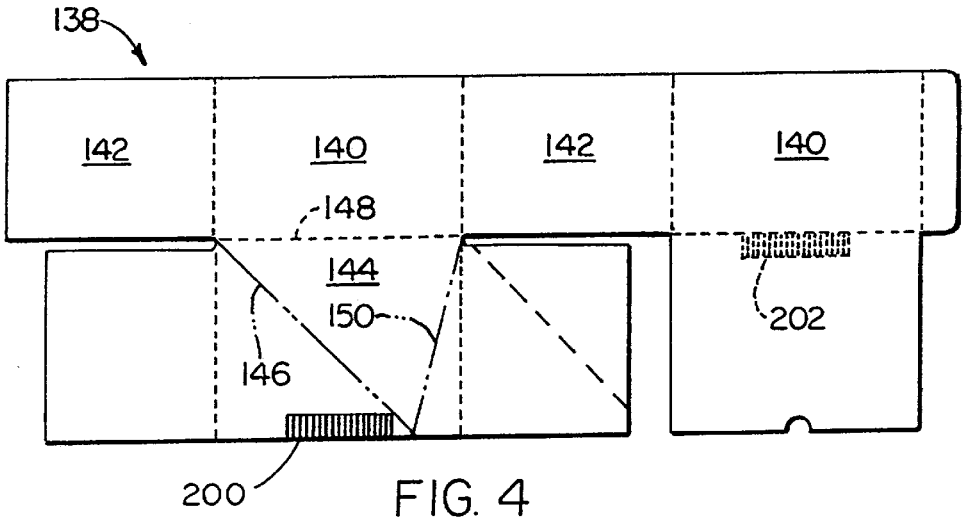
FIG. 4 is a simplified schematic view of a corrugated blank for assembly into the box of this invention wherein the width of the box sides is less than twice the width of the box ends.

Alternative blanks for the creation of the box of this invention are shown in FIGS. 3, 4, and 5. The alternative blanks illustrate, in simplified form, the three possible box length to width ratios, and the treatment of the automatic bottom panel to preserve the desirable assembly features of this invention. A first dry seal adhesive region 200, and a second dry seal adhesive region 202 is shown on each of the embodiments illustrated in FIGS. 3, 4, and 5.

As shown in FIG. 3, the box 126 has side panels 128 which are more than twice the width of the end panels 130. The box 126 thus has an automatic bottom panel 131 first reverse score line 132 which extends at an angle of 45 degrees from the bottom fold line 134, and a second reverse score fold line 136 which is at least 45 degrees from a line perpendicular to the bottom fold line. It should be noted however, that the angle of the second reverse score fold line 136 may be at a greater angle, up to the angle at which the first reverse score fold line and the second reverse score fold line meet at the outer perimeter of the automatic bottom panel. The first dry seal adhesive region 202 extends across both the first reverse score line 132 and the second reverse score fold line 136.

Another alternative embodiment box 138, shown in FIG. 4, is similar to the box 20, and has side panels 140 which are less than twice the width of the end panels 142. In such a box, the automatic bottom panel 144 again has a first reverse score fold line 146 which extends from the bottom fold line 148 at an angle of 45 degrees, while the second reverse score fold line 150 is positioned to extend from a point adjacent the corner of the automatic bottom panel along the bottom fold line 148 to a point along the outer perimeter of the automatic bottom panel meeting the first fold line 146. The first dry seal adhesive region in this embodiment, does not cross the first reverse score fold line 146.

Another alternative embodiment box 152, shown in FIG. 5, illustrates the third case, in which the side panels 154 are approximately the same width as the end panels 156. The box 152 has an automatic bottom panel 158 with a first reverse score fold line 160 which extends from the bottom fold line 162, and a second reverse score fold line 164 which also extends from the bottom fold line. The first and second fold lines 160, 164, extend from opposite corners of the automatic bottom panel 158 and cross as they extend to the outer perimeter of the automatic bottom panel. The triangular region between the outer perimeter and the crossed fold lines 160, 164 defines a cut-out 166 which is removed. The angle of the first fold line 160 with respect to the bottom fold line is, again, 45 degrees, while the angle of the second reverse fold line 164 with a line perpendicular to the bottom fold line is preferably about 60 degrees. The first dry seal adhesive region is broken into two segments, one on either side of the cut-out 166. Although the second dry seal adhesive region 202 may be likewise split into two segments, typically for ease of manufacture it will be applied as a single rectangular region.

It should be noted that the fold lines which have been discussed above as reverse score lines, may also be perf rolled, or otherwise treated to permit folding of portions of the automatic bottom panel in the directions desired.

It is understood that the invention is not limited to the particular construction and arrangement of parts herein illustrated and described, but embraces such modified forms thereof as come within the scope of the following claims.

I claim:

1. A corrugated paperboard article for assembly into a box, the article comprising:

a first side panel;

a first end panel which extends sidewardly from the first side panel;

a second end panel which extends sidewardly from the first side panel spaced from the first end panel;

a second side panel extending between and connected to the first end panel and the second end panel;

an automatic bottom panel which extends from the first side panel along a bottom fold line, the automatic bottom panel having an outer edge which is substantially parallel to the bottom fold line and which is spaced from the bottom fold line, wherein a first fold line extends from the bottom fold line to the automatic bottom panel outer edge, and wherein a second fold line extends from the bottom panel fold line to the bottom panel outer edge, such that the first fold line and the second fold line converge toward one another and terminate at the bottom panel outer edge;

a first region of dry seal adhesive positioned on the automatic bottom panel;

an interior bottom panel which extends from one of the first side panel and the second side panel;

a second region of dry seal adhesive positioned on the interior bottom panel, such that when the article is erected into a container, the interior bottom panel is positioned to overlie the automatic bottom panel, such that the second region of dry seal adhesive engages and adheres to the first region of dry seal adhesive, thereby connecting the automatic bottom panel to the interior bottom panel;

a first end flap which extends from the automatic bottom panel along a first end flap fold line, a first angle being defined between the first end flap fold line and the first fold line, wherein a portion of the first end flap is adhesively connected to the first end panel, to form a multi-ply end wall; and a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels.

2. The article of claim 1 wherein the first region of dry seal adhesive extends approximately adjacent to the automatic bottom panel outer edge, and wherein the second region of dry seal adhesive extends approximately adjacent the fold line between the side panel from which the interior bottom panel extends.

3. A corrugated paperboard article for assembly into a box, the article comprising:

a first side panel;

a first end panel which extends sidewardly from the first side panel;

a second end panel which extends sidewardly from the first side panel spaced from the first end panel;

a second side panel extending between and connected to the first end panel and the second end panel;

an automatic bottom panel which extends from the first side panel along a bottom fold line, the automatic bottom panel having an outer edge which is spaced from the bottom fold line, wherein a first fold line extends from the bottom fold line to the automatic bottom panel outer edge, and wherein a second fold line extends from the bottom panel fold line to the bottom panel outer edge, such that the first line and the second fold line converge toward one another;

a first end flap which extends from the automatic bottom panel along a first end flap fold line, a first angle being defined between the first end flap fold line and the first fold line, wherein the first angle is 45 degrees, and wherein a portion of the first end flap is adhesively connected to the first end panel, to form a multiply end wall;

a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels, and wherein the first fold line on the automatic bottom panel crosses the second fold line on the automatic bottom panel, to define a cut-out which extends between the crossed first fold line and the second fold line and the outer edge of the automatic bottom panel, and wherein the second angle is 60 degrees;

a first region of dry seal adhesive positioned on the automatic bottom panel;

an interior bottom panel which extends from one of the first side panel and the second side panel; and a second region of dry seal adhesive positioned on the interior bottom panel, such that when the article is erected into a container, the interior bottom panel is positioned to overlie the automatic bottom panel, such that the second region of dry seal adhesive engages and adheres to the first region of dry seal adhesive, thereby connecting the automatic bottom panel to the interior bottom panel.

4. The article of claim 3 wherein the first region of dry seal adhesive extends approximately adjacent to the automatic bottom panel outer edge, and wherein the second region of dry seal adhesive extends approximately adjacent the fold line between the side panel from which the interior bottom panel extends.

* * * * *